US005469638A

United States Patent [19]

Crawford, III

[11] Patent Number: 5,469,638

[45] Date of Patent: Nov. 28, 1995

[54] FOREFOOT SPRING APPARATUS

[75] Inventor: Howard E. Crawford, III, Calabasas, Calif.

[73] Assignee: Medical Materials Corporation, Camarillo, Calif.

[21] Appl. No.: 248,955

[22] Filed: May 25, 1994

Related U.S. Application Data

[63] Continuation of Ser. No. 27,313, Mar. 5, 1993, abandoned.

[51] Int. Cl.[6] ..... A43B 13/18; A43B 13/28

[52] U.S. Cl. ..... 36/28; 36/27

[58] Field of Search ..... 36/27, 28, 27, 36/38, 7.8

[56] References Cited

U.S. PATENT DOCUMENTS

| | | | |
|---|---|---|---|
| 4,534,124 | 8/1985 | Schnell | 36/7.8 X |
| 4,756,095 | 7/1988 | Lakic | 36/27 X |
| 4,815,221 | 3/1989 | Diaz | 36/37 X |
| 5,179,791 | 1/1993 | Lain | 36/27 |

*Primary Examiner*—Paul T. Sewell
*Assistant Examiner*—BethAnne C. Cicconi
*Attorney, Agent, or Firm*—Ellsworth R. Roston; Charles H. Schwartz

[57] ABSTRACT

Athletic and other footwear has an upper and also an insole, a midsole and an outsole in successive layers. The midsole may be made from a flexible material (e.g. polyurethane or EUA) and may be shaped to conform to the shapes of the insole and the outsole. A cavity in the midsole at a forefoot position extends from the top surface to a position near the bottom surface of the midsole. The cavity may extend downwardly and rearwardly at an angle of approximately 10°–45°, preferably approximately 15° to the horizontal. The cavity may be undercut to provide a recess at the bottom of the cavity. A spring disposed in the cavity may have a slightly concave configuration in the cavity. The spring may have a flat configuration at the opposite ends of the spring in the longitudinal direction. The spring may be made from a fabric material woven with a warp and a fill and impregnated with a resin material. The spring may extend rearwardly past the cavity to a position substantially flush with the top surface of the midsole. The cavity and the spring may be disposed to provide the spring with potential energy having components in the upward and forward directions when the wearer's foot is disposed on the ground. When the wearer's foot is lifted from the ground, the potential energy in the spring is released to facilitate the movement of the foot upwardly and forwardly. The spring provides a dynamic response, durability, strength and adequate flex in the forefoot.

38 Claims, 2 Drawing Sheets

FIG. 1
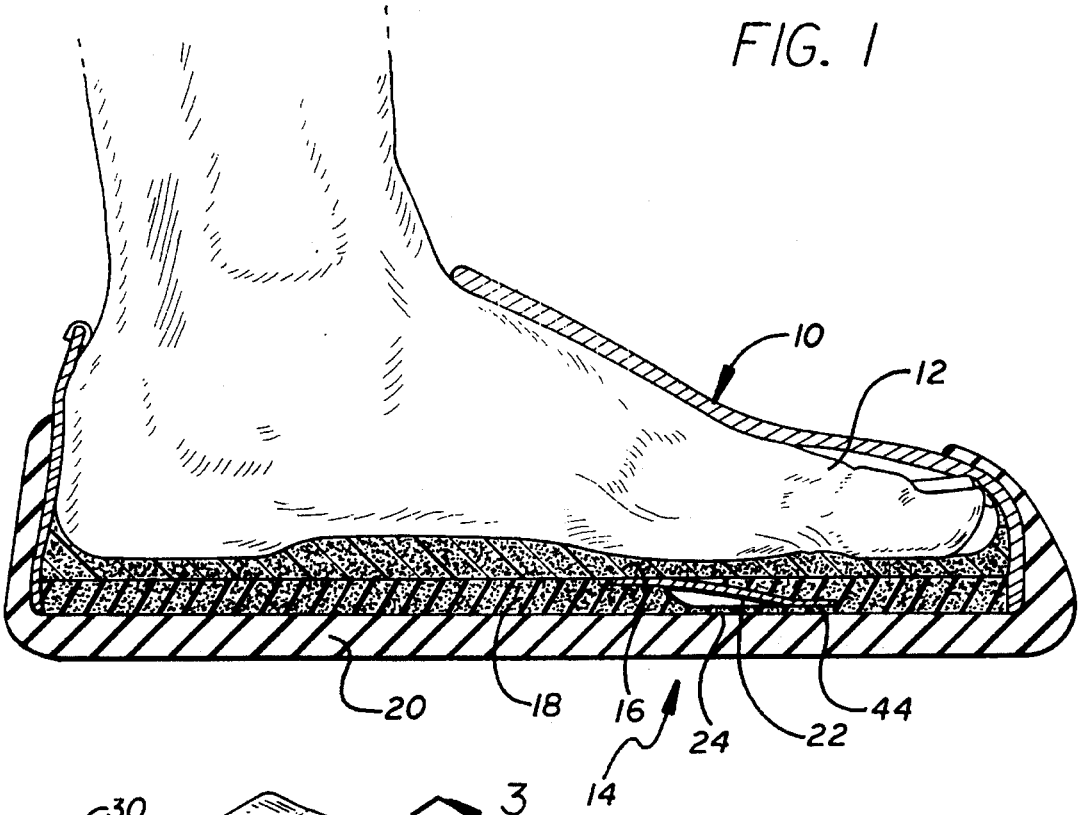
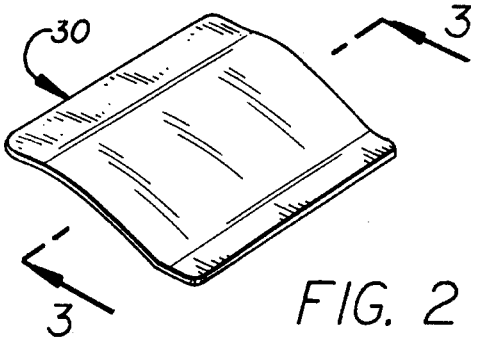
FIG. 2
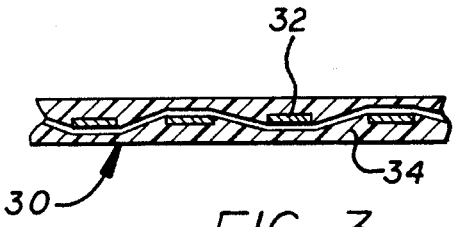
FIG. 3
FIG. 4
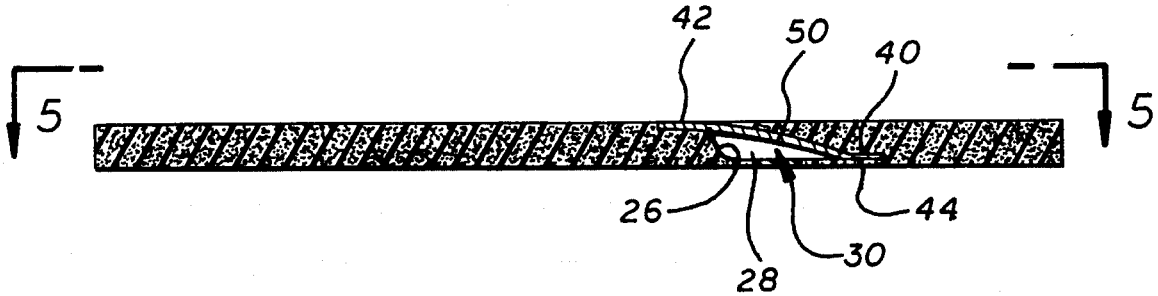

FOREFOOT SPRING APPARATUS

This is a continuation of application Ser. No. 08/027,313, filed Mar. 5, 1993, now abandoned.

This invention relates to an article for use in footwear to facilitate movements by the wearer of the footwear such as during walking, jogging, jumping or running. The invention particularly relates to an article including a forefoot spring and a cavity in a midsole for receiving the forefoot spring in a relationship to produce potential energy in an upward and forward direction during the movement of a foot against the ground and to release the potential energy upon the movement of the foot from the ground.

When an individual walks, jogs, jumps or runs, he dissipates a considerable amount of energy in raising his foot and then lowering it to impact his foot against the ground. It has been recognized for some time that it would be desirable to convert at least some of this energy to potential energy which would be released when the individual would lift his foot from the ground. The release of this energy would facilitate the walking, jogging or running of the individual. There would also be other benefits. For example, storing the energy provides shock absorption when the forefoot impacts the ground.

A number of attempts have been made to capture potential energy during the downstroke of an individual's foot and to release the potential energy upon the upstroke of such individual's foot. Such attempts have not been successful. The various types of articles for capturing and releasing such energy have had several undesirable features. Such types of article have been relatively heavy or relatively bulky or relatively inefficient or have suffered from more than one (1) of these deficiencies. Because of this, such types of article have not been widely adopted.

In one embodiment: of the invention, athletic and other footwear has an upper and also has an insole, a midsole and an outsole in successive layers. The midsole may be made from a flexible material (e.g. polyurethane or EUA) and may be shaped to conform to the shapes of the insole and the outsole.

A cavity in the midsole at a forefoot position extends from the top surface to a position near the bottom surface of the midsole. The cavity may be undercut to provide a recess at the bottom end of the cavity. The cavity may extend downwardly and rearwardly at an angle of approximately 10°–45°, preferably at an angle of approximately 15°, to the horizontal. The cavity may be undercut to provide a recess at the bottom surface of the cavity.

A spring disposed in the cavity may have a slightly concave configuration in the cavity. The spring may be made from a fabric material woven with a warp and a fill and impregnated with a resin material. The spring may extend rearwardly past the cavity. The spring may have a flat configuration at the opposite ends of the spring in the longitudinal direction.

The cavity and the spring may be disposed to provide the spring member with potential-energy having components in the upward and forward directions when the foot of the wearer is disposed on the ground. When the foot of the wearer is lifted from the ground, the potential energy in the spring member is released to facilitate the movement of the foot upwardly and forwardly. The spring provides a dynamic response, durability, strength and adequate flex in the forefoot.

In the drawings:

FIG. 1 is a sectional view of a footwear such as a shoe;

FIG. 2 is a perspective view of a spring disposed in the midsole of the shoe;

FIG. 3 is a sectional view of the spring and is taken substantially on the line 3—3 of FIG. 2;

FIG. 4 is an enlarged sectional view of the midsole and the spring as shown in FIG. 1;

Figure 5:
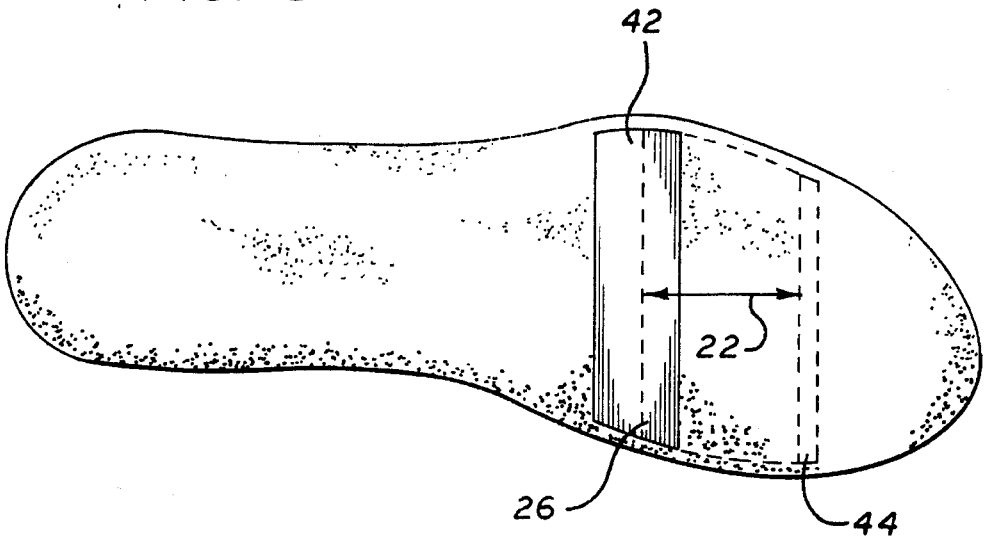
FIG. 5 is an enlarged fragmentary sectional view showing the midsole and the spring and is taken substantially on the line 5—5 of FIG. 4.
Figure 6:
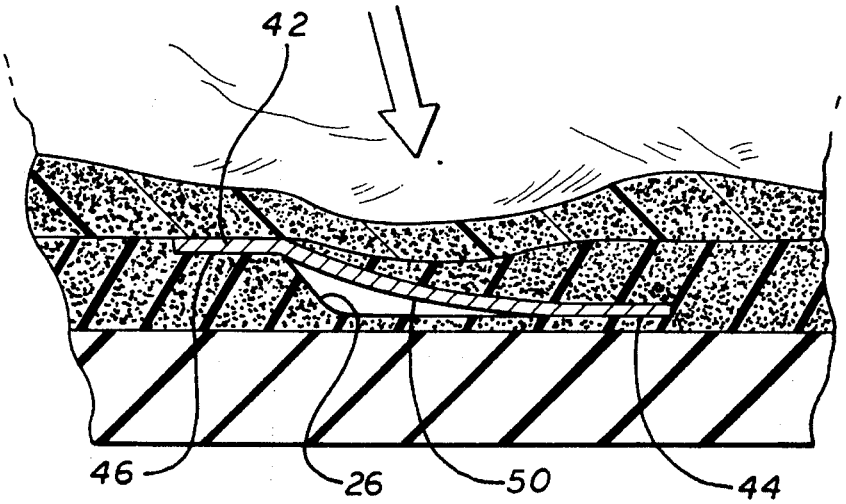
Figure 7:
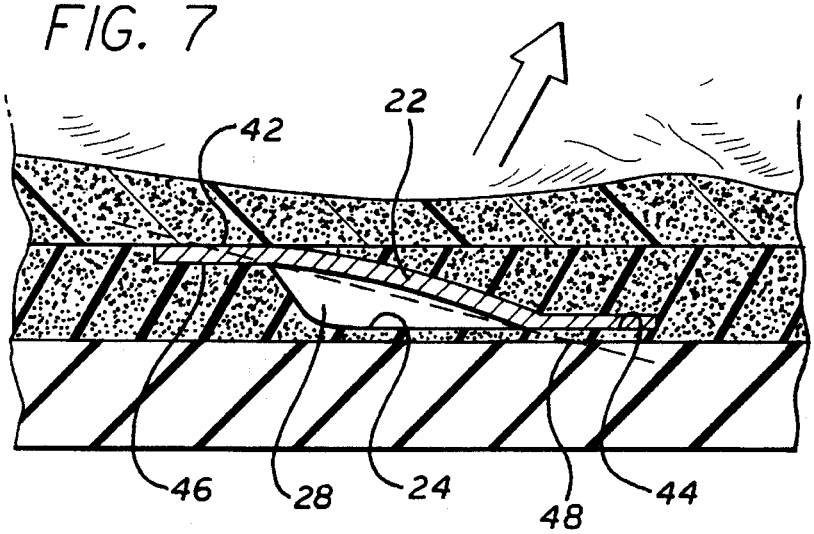

FIG. 6 is an enlarged fragmentary sectional view of the insole, the midsole, the spring and the outsole similar to that shown in FIG. 1 and shows the position of the spring when a force has been applied to the spring by the disposition of the forefoot of the footwear on the ground; and FIG. 7 is a view similar to that shown in FIG. 6 and illustrates the midsole, the spring, the insole and the outsole when the weight has been released from the forefoot of the footwear.

In one embodiment of the invention, footwear generally indicated at 10, such as an athletic or other type of shoe, is provided. The footwear 10 may be provided with an upper 12 made from a suitable material such as a leather, a plastic or a cloth. A sole generally indicated at 14 may be attached to the upper 12. The sole 14 may be formed from an insole 16, a midsole 18 attached at its upper surface to the insole and an outsole 20 attached to the lower surface of the midsole. The midsole 18 may be made from a suitable flexible material such as a polyurethane (e.g. PU) or EUA and may be provided with a suitable thickness such as approximately three eighths of an inch (⅜") in the forefoot to seven eighths of an inch (⅞") in the heel. The midsole 18 may be flat with opposite parallel surfaces and may be provided with a configuration corresponding to the configuration of the insole 16 and the outsole 20.

A cavity 22 may be provided in the midsole 18 at the position of the forefoot. The cavity 22 may extend from the top surface of the midsole 18 downwardly and forwardly to a position almost at the bottom of the midsole. In this way, a surface 24 is provided at the bottom of the midsole 18. Preferably the cavity 22 has an angle between approximately ten degrees (10°) and forty five degrees (45°) with the bottom surface of the midsole 18. The angle is optimally about 15°. The cavity 22 may extend laterally across the full width of the midsole 18 at the forefoot position. The cavity 22 is undercut as at 26 to define a recess 28. The bottom surface of the recess is defined by the surface 24.

A spring generally indicated at 30 is disposed in the cavity 22. The spring 30 may be formed from a fabric material 32 impregnated with a resin material 34. The resin material may be thermoplastic or thermosetting. A suitable thermoplastic material is an acrylic. The resin material 34 preferably covers the fabric 32.

The fabric material 32 may be formed from a suitable material such as a graphite, glass or nylon. The fabric material 32 may have a warp and a fill with the fill formed from a different material than the warp. Carbon fibers are advantageous because they provide a high resilience and strength. The spring 30 may be provided with a suitable thickness in the order of thirty three mils (0.033"). However, the thickness of the spring member 24 may preferably vary between approximately fifteen and seventy five mils (0.015"–0.075") and may even be smaller or larger than these ranges. The use of a composite material as the spring 30 as described above is advantageous because it provides the spring with excellent springlike characteristics.

The spring 30 is preferably provided with a flat portion 42 at its upper rear end and with a flat portion 44 at its lower forward end. The portions 42 and 44 are preferably horizontal in the unconstrained position of the spring member.

The portion 42 rests on a ledge 46 formed by cutting the top of the midsole 18. The ledge 46 is sufficiently below the top surface of the midsole 18 such that the upper surface of the flat portion 42 is substantially flush with the top surface of the midsole. The flat portion 44 is disposed in a socket 48 having an extension of the surface 24 as its bottom surface.

The spring 30 is also preferably provided with a portion 50 intermediate the flat portions 42 and 44. The portion 50 is disposed at an acute angle relative to the flat portions 42 and 44. Preferably this angle is between about 10° and 45°. An optimum value may be about 15°. The angle is formed by the extension of the portion 50 downwardly and rearwardly. The portion 50 is disposed above the recess 28. Preferably the portion 50 has a slightly concave configuration.

The spring 30 is normally disposed against the upper surface of the cavity 22 as shown in FIG. 6. In this position, the spring 30 is separated by the recess 28 from the bottom surface 24. When the foot of the wearer is disposed against the ground as by walking, jogging, jumping or running, the spring 30 becomes depressed in the cavity 22 to the position shown in FIG. 6. This causes the spring 30 to store potential energy with a component in an upward direction and another component in a forward horizontal direction because of the disposition of the cavity 22 and the spring 30 in the midsole 18. The spring 30 also absorbs shock during the compression of the spring as shown in FIG. 6. When the foot is released from the ground, the spring 30 converts the potential energy to kinetic energy with components in the forward and upward directions. This facilitates the walking, running, jumping or jogging of the wearer.

The footwear 10 described above and constituting this invention has certain important advantages. The spring 30 is light in weight. Actually, the spring 30 may provide a reduction in the weight of the footwear 10 since it provides for the removal of foam from the footwear. The spring 30 is effective in storing and releasing potential energy. It uniformly absorbs the shock of the impact of the footwear 10 against the ground during its compression to the configuration shown in FIG. 6. It stores the potential energy efficiently during the impact of the footwear against the ground and returns the energy efficiently to the wearer of the footwear after the wearer has lifted his foot from the ground.

The footwear 10 constituting this invention has other important advantages. The spring 30 has a thin profile so that it does not affect the visual appearance of the footwear 10. It provides a substantially fixed position of the flat portions 42 and 44 so that the intermediate portion 50 cannot become displaced horizontally when it becomes depressed by the disposition of the forefoot of the wearer on the ground. The spring 30 can also be reformed if it has not been shaped properly after a first forming when it is formed from a fabric impregnated with a thermoplastic material.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination, footwear having a forefoot and including:

a midsole having opposite surfaces, an insole disposed on one surface of the midsole in coupled relationship to the midsole, an outsole disposed on the other surface of the midsole in coupled relationship to the midsole, the midsole having a cavity across substantially the lateral width of the midsole at the position of the forefoot of the footwear, the cavity extending forwardly and downwardly in the midsole, and a spring disposed in the cavity across substantially the lateral width of the cavity for receiving potential energy upon the disposition of the forefoot of the footwear on the ground and for releasing this potential energy upon the lifting of the forefoot of the footwear from the ground, the midsole having flat surfaces, the cavity being disposed at an acute angle relative to the flat surfaces of the midsole in a forwardly and downwardly facing direction from the top of the midsole, and the spring being disposed in the cavity to provide a component of the potential energy in the forward direction and a component of the potential energy in the upward direction upon the disposition of the forefoot of the footwear on the ground, the cavity and the spring being disposed relative to each other to provide an abutting relationship between the midsole and the spring in the forward and downward extension of the cavity when the forefoot of the footwear is on the ground and when the forefoot of the footwear is off the ground.

2. In combination, footwear having a forefoot and including:

a midsole having opposite surfaces, an insole disposed on one surface of the midsole in coupled relationship to the midsole, an outsole disposed on the other surface of the midsole in coupled relationship to the midsole, the midsole having a cavity across substantially the lateral width of the midsole at the position of the forefoot of the footwear, and a spring disposed in the cavity across substantially the lateral width of the cavity for receiving potential energy upon the disposition of the forefoot of the footwear on the ground and for releasing this potential energy upon the lifting of the forefoot of the footwear from the ground, the midsole having flat surfaces, the cavity being disposed at an acute angle relative to the flat surfaces of the midsole in a forwardly facing direction from the top of the midsole, and the spring being disposed in the cavity to provide a component of the potential energy in the forward direction and a component of the potential energy in the upward direction upon the disposition of the forefoot of the footwear on the ground, the midsole having flat surfaces, the midsole having an upper surface, and the midsole having a ledge on its upper surface at the rear end of the cavity, and the rear end of the spring being disposed on the ledge on the midsole to retain the spring fixedly positioned in the cavity in the longitudinal direction and the upper surface of the spring at positions forward of the ledge engaging the midsole at positions on the midsole defining the upper surface of the cavity.

3. In a combination as set forth in claim 1 wherein the spring is made from a fabric impregnated with a resin material and wherein the spring engages the midsole along substantially the full forward and downward extension of the cavity when the forefoot of the footwear is on the ground and when the forefoot of the footwear is off the ground.

4. In combination, footwear having a forefoot and including:

a midsole having opposite surfaces, an insole disposed on one surface of the midsole in coupled relationship to the midsole, an outsole disposed on the other surface of the midsole in coupled relationship to the midsole, the midsole having a cavity across substantially the lateral width of the midsole at the position of the forefoot of the footwear, and a spring disposed in the cavity across substantially the lateral width of the cavity for receiving potential energy upon the disposition of the forefoot of the footwear on the ground and for releasing this potential energy upon the lifting of the forefoot of the footwear from the ground, the midsole having flat surfaces, the cavity being disposed at an acute angle relative to the flat surfaces of the midsole in a forwardly facing direction from the top of the midsole, and the spring being disposed in the cavity to provide a component of the potential energy in the forward direction and a component of the potential energy in the upward direction upon the disposition of the forefoot of the footwear on the ground, the midsole being provided with upper and lower surfaces and the spring being provided with flat configurations at its forward and rear ends and, between the flat ends, with an intermediate portion integral with the flat configurations of the spring and at an acute angle relative to the flat configurations of the spring and the flat configuration of the spring at the rear end of the spring being engaged by the upper surface of the midsole and the flat configuration of the spring at the forward end of the spring being engaged by the lower surface of the midsole.

5. In a combination as set forth in claim 4, the cavity being undercut to define a recess and to provide for a bending of the intermediate portion of the spring into the recess upon the disposition of the forefoot of the footwear on the ground and the cavity and the spring being disposed relative to each other to provide an engagement between the midsole and the spring at the positions of the cavity when the forefoot of the footwear is on the ground and when the forefoot of the footwear is off the ground.

6. In a combination as set forth in claim 5, the intermediate portion of the spring between the flat portions having a concave configuration relative to the flat portions of the spring and the spring engaging the midsole along substantially the full length of the cavity when the forefoot of the footwear is on the ground and when the forefoot of the footwear is off the ground.

7. In combination, footwear having a forefoot and including:

a midsole having opposite surfaces, an insole disposed on one surface of the midsole in coupled relationship to the midsole, an outsole disposed on the other surface of the midsole in coupled relationship to the midsole, the midsole having a cavity across substantially the lateral width of the midsole at the position of the forefoot of the footwear, and a spring disposed in the cavity for receiving potential energy upon the disposition of the forefoot of the footwear on the ground and for releasing this potential energy upon the lifting of the forefoot of the footwear from the ground, the midsole having flat surfaces, the cavity being disposed at an acute angle relative to the flat surfaces of the midsole in a forwardly facing direction from the top of the midsole, the spring being disposed in the cavity to provide a component of the potential energy in the forward direction and a component of the potential energy in the upward direction upon the disposition of the forefoot of the footwear on the ground, the spring being provided with flat configurations at its forward and rear ends and, between the flat ends, with an intermediate portion integral with the flat configuration of the spring and angled relative to the flat configuration of the spring, the cavity being undercut to define a recess and to provide for a bending of the intermediate portion of the spring into the recess upon the disposition of the forefoot of the footwear on the ground, and the flat configuration at the rear end of the spring being disposed on the top surface of the midsole and the cavity being provided with a socket at its forward end and the flat configuration of the spring at the forward end being disposed in the socket.

8. In a combination as set forth in claim 7, the socket being formed on a surface near the bottom of the midsole and a particular surface in the midsole defining an upper boundary of the recess and the intermediate portion of the spring being disposed against the particular surface of the midsole when the forefoot of the spring is not disposed against the ground.

9. In combination, footwear having a sole and having a forefoot and further including:

a midsole having the shape of the sole and having top and bottom surfaces, a cavity in the midsole at a position corresponding to the forefoot of the footwear, the cavity extending forwardly and downwardly in the midsole, and a spring disposed in the cavity along substantially the the forward and downward extension of the cavity to store potential energy upon the disposition of the forefoot of the footwear on the ground and to convert the potential energy to kinetic energy upon the movement of the forefoot of the footwear from the ground, the cavity being disposed at an acute angle in the forward and downward extension in the midsole relative to the top and bottom surfaces of the midsole, the spring having, between the opposite ends of the spring, an intermediate portion which is integral with the opposite ends of the spring in the forward and downward extension and which is disposed at an acute angle relative to such opposite ends to provide potential energy having forward and upward components upon the disposition of the forefoot of the footwear on the ground, the cavity being reduced in size upon a disposition of the forefoot of the footwear on the ground, the spring and the cavity in the midsole being constructed and disposed relative to each other to provide an abutting of the midsole against the intermediate portion of the spring in the forward and downward extension of the cavity when the forefoot of the footwear is on the ground and when the forefoot of the footwear is off the ground.

10. In a combination as set forth in claim 9, the forward and downward extension of the cavity and the intermediate portion of the spring being disposed at an angle between approximately 10° and approximately 45° relative to the top and bottom surfaces of the midsole to provide the spring with the potential energy in the upward and forward directions upon the disposition of the forefoot of the footwear on the ground, the spring abutting the midsole along substantially the full forward and downward extension of the cavity when the forefoot of the wearer is on the ground and when the forefoot of the wearer is off the ground.

11. In a combination as set forth in claim 9, the spring being formed from a fabric material impregnated with a resin material, the forward and downward extension of the cavity and the intermediate portion of the spring being disposed at an angle of approximately 15° relative to the top and bottom surfaces of the midsole to provide the spring with the potential energy in the upward and forward directions upon the disposition of the spring on the ground.

12. In a combination as set forth in claim 7, the cavity being undercut in the forward and downward extension of the cavity to define a recess and to provide for the displacement of the intermediate portion of the spring into the recess upon the disposition of the forefoot of the footwear on the ground.

13. In a combination as set forth in claim 12, the midsole having an intermediate portion, and the cavity having an upper surface and the intermediate portion of the spring being disposed in the forward and downward extension of the cavity against the midsole at the upper surface of the cavity when the forefoot is not disposed on the ground and the intermediate portion of the midsole abutting the intermediate portion of the spring at the upper surface of the cavity when the forefoot is on the ground.

14. In combination, footwear having a sole and having a forefoot and further including:

a midsole having the shape of the sole and having top and bottom surfaces, a cavity in the midsole at a position corresponding to the forefoot of the footwear, and a spring disposed in the cavity along substantially the length of the cavity to store potential energy upon the disposition of the forefoot of the footwear on the ground and to convert the potential energy to kinetic energy upon the movement of the forefoot of the footwear from the ground, the cavity being disposed at an acute angle in the midsole relative to the top and bottom surfaces of the midsole, the spring having, between the opposite ends of the spring, an intermediate portion which is integral with the opposite ends of the spring and which is disposed at an acute angle relative to such opposite ends to provide potential energy having forward and upward components upon the disposition of the forefoot of the footwear on the ground, the cavity being reduced in size upon a disposition of the forefoot of the footwear on the ground, the spring and the cavity in the midsole being constructed and disposed relative to each other to provide for an engagement of the midsole against the intermediate portion of the spring at the positions of the cavity when the forefoot of the footwear is on the ground and when the forefoot of the footwear is off the ground, the cavity being undercut to define a recess and to provide for the displacement of the intermediate portion of the spring into the recess upon the disposition of the forefoot of the footwear on the ground, the midsole having an intermediate portion, and the upper surface of the cavity being defined by a particular surface and the intermediate portion of the spring being disposed against the midsole along the particular surface of the cavity when the forefoot is not disposed on the ground and the intermediate portion of the midsole and the being bent into the recess when the forefoot is on the ground, the spring having flat portions at the forward and rear ends of the spring, the flat portion at the rear end of the spring being disposed on the midsole in substantially flush relationship with the top surface of the midsole and a socket extending from the cavity in continuous relationship with the recess at the forward end of the cavity and the flat portion of the spring at the forward end being disposed in the socket.

15. In a combination as set forth in claim 9, the spring being made from a fabric material impregnated with a resin material, the fabric material having a warp and a fill, the forward and downward extension of the cavity and the intermediate portion of the spring being disposed at an angle between approximately 10° and approximately 45° relative to the top and bottom surfaces of the midsole.

16. In combination, footwear having a sole and having a forefoot and further including:

a midsole having the shape of the sole, a cavity in the midsole at a position corresponding to the forefoot of the footwear, and a spring disposed in the cavity along substantially the length of the cavity to store potential energy upon the disposition of the forefoot of the footwear on the ground and to convert the potential energy to kinetic energy upon the movement of the forefoot of the footwear from the ground, the cavity being disposed in a direction in the midsole, and the spring being disposed in the cavity, to provide forward and upward components to the potential energy, the spring having, between the opposite ends of the spring, an intermediate portion which is integral with the opposite ends of the spring and which is disposed at an acute angle relative to such opposite ends along substantially the full distance between such opposite ends to provide potential energy having forward and upward components upon the disposition of the forefoot of the footwear on the ground, the spring being formed from a fabric material impregnated with a resin material, the fabric material having a warp and a fill, the intermediate portion of the spring having a concave configuration relative to the flat portions at the opposite ends of the spring, the intermediate portion of the midsole engaging the intermediate portion of the spring along substantially the full distance of the cavity between the opposite ends of the spring when the forefoot of the footwear is on the ground and off the ground.

17. In combination, footwear having a sole and having a forefoot and further including:

a midsole having the shape of the sole, a cavity in the midsole at a position corresponding to the forefoot of the footwear, a spring disposed in the cavity to store potential energy upon the disposition of the forefoot of the footwear on the ground and to convert the potential energy to kinetic energy upon the movement of the forefoot of the footwear from the ground, the cavity being disposed in a direction in the midsole, and the spring being disposed in the cavity, to provide forward and upward components to the potential energy, the spring having, between the opposite ends of the spring, an intermediate portion which is integral with the opposite ends of the spring and which is disposed at an angle relative to such opposite ends to provide potential energy having forward and upward components upon the disposition of the forefoot of the footwear on the ground, the cavity being undercut to define a recess and to provide for the displacement of the intermediate portion of the spring into the recess upon the disposition of the forefoot of the footwear on the ground, the upper surface of the cavity being defined by a particular surface in the midsole and the intermediate portion of the midsole being disposed against the particular surface of the cavity when the forefoot is not disposed on the ground and the intermediate portion being bent into the recess when the forefoot is on the ground, the midsole having a top surface, and the spring having a flat portion at the rear end of the spring and the flat portion being disposed on the midsole in substantially flush relationship with the top surface of the midsole and a socket extending from the cavity in continuous relationship with the recess at the forward end of the cavity and the spring having at the forward end a flat portion disposed in the socket, and the bottom of the socket being defined by a surface near the bottom surface of the midsole and the flat portion at the forward end of the spring being disposed on such surface in the socket.

18. In a combination as set forth in claim 17, the midsole also having a bottom surface and the top and bottom surfaces of the midsole having flat configurations, the midsole being made from a flexible material and the cavity and a portion of the spring being disposed at an angle of approximately 15° relative to the flat surfaces of the midsole to provide the spring with the potential energy in the upward and forward directions.

19. In combination for disposition on a wearer's foot, footwear having a forefoot and having an upper, an insole and an outsole, the upper being disposed above the insole, a midsole disposed in the footwear between the insole and the outsole, there being in the midsole a cavity extending forwardly from the top of the midsole toward the bottom of the midsole, and a spring disposed in the cavity along substantially the length of the cavity for storing potential energy with components in the forward and upward directions upon the disposition of the forefoot of the footwear on the ground and for releasing this potential energy upon the lifting of the forefoot of the footwear from the ground, the spring being provided with flat portions at its front and rear ends and being provided with an intermediate portion between its front and rear ends, the flat portion of the spring at the rear end being above the flat portion of the spring at the forward end, the intermediate portion being integral with the flat portions and being disposed at an acute angle relative to the flat portions, and the cavity being formed at its front and rear ends to retain the flat portions of the spring in a fixed relationship to the midsole.

20. In combination for disposition on a wearer's foot, footwear having a forefoot and an upper, an insole and an outsole, the upper being disposed above the insole, a midsole disposed in the footwear between the insole and the outsole, there being in the midsole a cavity extending forwardly from the top of the midsole toward the bottom of the midsole, and a spring disposed in the cavity for storing potential energy with components in the forward and upward directions upon the disposition of the forefoot of the footwear on the ground and for releasing this potential energy upon the lifting of the forefoot of the footwear from the ground, the spring being provided with flat portions at its front and rear ends and being provided with an intermediate portion between its front and rear ends, the intermediate portion being integral with the flat portions and being disposed at an angle relative to the flat portions, the spring extending rearwardly beyond the rear end of the cavity and resting on the top surface of the midsole at its rear end.

21. In a combination as set forth in claim 17, the intermediate portion of the spring being integral with the flat portions of the spring and being disposed at an acute angle relative to the flat portions.

22. In a combination as set forth in claim 21, the intermediate portion of the spring being at an angle between approximately 10° and approximately 45° relative to the flat portions of the spring when the forefoot is not on the ground.

23. In a combination as set forth in claim 21, the intermediate portion of the spring being concave relative to the flat portions when the forefoot is not on the ground.

24. In a combination as set forth in claim 21, the spring being made from a fabric impregnated with a resin material, the cavity and the intermediate portion of the spring being disposed at an angle between approximately 10° and approximately 45° relative to the flat surfaces of the spring.

25. In a combination as set forth in claim 21, the cavity being undercut to define a recess and to provide for a displacement of the intermediate portion of the spring downwardly into the recess upon the disposition of the forefoot of the footwear on the ground, the intermediate portion of the spring being concave relative to the flat portions of the spring when the forefoot is not on the ground, the spring being made from a fabric material impregnated with a resin material.

26. In combination for disposition on a wearer's foot, footwear having a forefoot and an upper, an insole and an outsole, the upper being disposed above the insole, a midsole disposed in the footwear between the insole and the outsole, there being in the midsole a cavity extending forwardly from the top of the midsole toward the bottom of the midsole, and a spring disposed in the cavity for storing potential energy with components in the forward and upward directions upon the disposition of the forefoot of the footwear on the ground and for releasing this potential energy upon the lifting of the forefoot of the footwear from the ground, the spring being provided with flat portions at its front and rear ends and being provided with an intermediate portion between its front and rear ends, the intermediate portion being integral with the flat portions and being disposed at an angle relative to the flat portions, the cavity being undercut to define a recess and to provide for a displacement of the intermediate portion of the spring downwardly into the recess upon the disposition of the forefoot of the footwear on the ground, the intermediate portion of the spring being concave relative to the flat portions of the spring when the forefoot is not on the ground, the spring being made from a fabric material impregnated with a resin material, the fabric material having a warp and a fill, the flat portion at the rear end of the spring being disposed on the midsole in substantially flush relationship with the top surface of the midsole and a socket extending from the forward end of the cavity in continuous relationship with the cavity near the bottom of the midsole and the flat portion at the forward end of the cavity being disposed in the socket.

27. In a combination as set forth in claim 26, the midsole being made from a flexible material and the cavity being disposed at an angle between approximately 10° and approximately 45° relative to the horizontal with the cavity extending downwardly and rearwardly from the top end of the midsole and the upper end of the midsole being defined by a particular surface in the midsole and the intermediate portion of the spring being disposed against the particular surface of the midsole when the forefoot is not on the ground and the intermediate portion of the spring being bent into the recess when the forefoot is on the ground.

28. In combination for disposition on a wearer's foot, footwear having a forefoot and having an upper, an insole and an outsole, the upper being disposed above the insole, a midsole disposed in the footwear between the insole and the outsole, there being in the midsole a cavity extending forwardly from the top of the midsole toward the bottom of the midsole, and a spring disposed in the cavity for storing potential energy with components in the forward and upward directions upon the disposition of the forefoot of the footwear on the ground and for releasing this potential energy upon the lifting of the forefoot of the footwear from the ground, the spring being provided with flat portions at its front and rear ends and being provided with an intermediate portion between its front and rear ends, the intermediate portion being integral with the flat portions and being disposed at an acute angle relative to the flat portions, the spring extending rearwardly beyond the rear end of the cavity and resting on the top surface of the midsole at its rear end, there being a socket in the cavity at the bottom and forward end of the cavity and the flat portion of the spring at the front end of the spring being disposed in the socket.

29. In a combination as set forth in claim 28, the spring being made from a fabric impregnated with a resin material, and the intermediate portion of the spring having a concave configuration relative to the flat portions of the spring when the forefoot is not on the ground and the intermediate portion of the spring being bent from the concave configuration when the forefoot is on the ground.

30. In a combination as set forth in claim 29, the midsole being made from a flexible material and the cavity being disposed at an angle of approximately 15° relative to the flat portions of the spring and the socket being partially defined by a particular surface near the bottom of the midsole and the flat portion of the spring at the front end of the spring being disposed on the particular surface in the socket.

31. In combination, footwear having a sole with a forefoot and further including:

a midsole made from a flexible material and contoured to the shape of the sole of the footwear, the midsole having upper and lower surfaces, there being a cavity in the midsole at the position of the forefoot, the cavity being disposed at an acute angle in the longitudinal direction relative to the upper and lower surfaces of the midsole, a spring disposed in the cavity at substantially the acute angle of the cavity in the forward direction and constructed to store potential energy with components in the upward and forward directions upon the disposition of the forefoot of the midsole on the ground and to release the potential energy upon the lifting of the forefoot of the midsole from the ground, an insole affixed to the upper surface of the midsole, and an outsole affixed to the lower surface of the midsole.

32. In a combination as set forth in claim 31, the midsole being made from a flexible material and the spring being made from a fabric material impregnated with a resin material.

33. In a combination as set forth in claim 31, the spring having horizontal flat portions at its upper and lower ends and having an intermediate portion disposed between the flat portions in integral relationship with the flat portions and disposed at substantially the angle relative to the flat portions, the flat portion at the upper end of the spring being disposed at the rear end of the spring and the flat portion at the lower end of the spring being disposed at the forward end of the spring.

34. In a combination as set forth in claim 31, the cavity being undercut to define a recess and to provide for a displacement of the intermediate portion of the spring into the recess of the cavity when the forefoot of the footwear is disposed on the ground.

35. In a combination as set forth in claim 32, the fabric material being provided with a warp and a fill and the resin material covering the fabric material and the upper end of the recess being defined by a particular surface in the midsole and the intermediate portion of the spring being disposed against the particular surface of the midsole when the forefoot is not on the ground and the spring being bent downwardly when the forefoot is on the ground.

36. In combination, footwear having a sole with a forefoot and further including:

a midsole made from a flexible material and contoured to the shape of the sole of the footwear, the midsole having upper and lower surfaces, there being a cavity in the midsole at the position of the forefoot, the cavity being disposed at an angle in the longitudinal direction relative to the upper and lower surfaces of the midsole, a spring disposed in the cavity and constructed to store potential energy with components in the upward and forward directions upon the disposition of the forefoot of the midsole on the ground and to release the potential energy upon the lifting of the forefoot of the midsole from the ground, an insole affixed to the upper surface of the midsole, an outsole affixed to the lower surface of the midsole, and the spring having horizontal flat portions at its upper and lower ends and having an intermediate portion disposed between the flat portions in integral relationship to the flat portions and disposed at substantially the angle relative to the flat portions, the flat portion at the upper end of the spring being disposed on the midsole in substantially flush relationship with the upper surface of the midsole and a socket extending forwardly from the cavity near the lower surface of the midsole and the flat end at the forward end of the spring being disposed in the socket.

37. In a combination as set forth in claim 36, the cavity being undercut to define a recess and to provide for a displacement of the intermediate portion of the spring into the recess of the cavity when the forefoot of the footwear is disposed on the ground, the intermediate portion of the spring having a concave configuration relative to the flat portions of the spring when the forefoot is not on the ground and the intermediate portion of the spring being bent from the concave configuration when the flat portion is on the ground.

38. In a combination as set forth in claim 36, the midsole being made from a flexible material and the spring being made from a fabric material having a warp and a fill, the fabric material being impregnated with a resin material, the angle of the cavity in the horizontal direction relative to the upper and lower surfaces of the midsole being between approximately 10° and approximately 45°.

* * * * *